US009069301B2

(12) United States Patent
Oi

(10) Patent No.: US 9,069,301 B2
(45) Date of Patent: Jun. 30, 2015

(54) IMAGE HEATING APPARATUS

(71) Applicant: CANON KABUSHIKI KAISHA, Tokyo (JP)

(72) Inventor: Ken Oi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/097,794

(22) Filed: Dec. 5, 2013

(65) Prior Publication Data

US 2014/0161473 A1 Jun. 12, 2014

(30) Foreign Application Priority Data

Dec. 11, 2012 (JP) ..... 2012-270299

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01); *G03G 2215/2035* (2013.01)

(58) Field of Classification Search
CPC ..... G03G 15/2039; G03G 15/2064
USPC ..... 399/33, 67, 69, 320
See application file for complete search history.

(56) References Cited

U.S. PATENT DOCUMENTS

| | | | | |
|---|---|---|---|---|
| 5,848,319 | A * | 12/1998 | Morigami et al. | 399/320 X |
| 6,075,228 | A | 6/2000 | Goto et al. | |
| 8,023,841 | B2 * | 9/2011 | Ishikawa | 399/33 |
| 8,600,259 | B2 | 12/2013 | Oi et al. | |
| 2011/0206402 | A1 * | 8/2011 | Yamashina | 399/69 |
| 2013/0108287 | A1 * | 5/2013 | Hayase et al. | 399/33 |
| 2013/0236199 | A1 * | 9/2013 | Yamamoto | 399/33 |
| 2013/0279926 | A1 * | 10/2013 | Yoshimura | 399/33 |

FOREIGN PATENT DOCUMENTS

JP H11-024492 A 1/1999

* cited by examiner

*Primary Examiner* — Sophia S Chen
(74) *Attorney, Agent, or Firm* — Fitzpatrick, Cella, Harper & Scinto

(57) ABSTRACT

An image heating apparatus includes a rotary member, a heating member configured to heat the rotary member, the heating member being held in contact with the rotary member, a temperature detecting element configured to detect the temperature of the rotary member or the heating member, a protection element configured to interrupt power supply to the heating member, the protection element being activated when sensing an abnormal rise in the temperature of the heating member, and a control portion configured to control the image heating apparatus. When the temperature detected by the temperature detecting element exceeds a threshold value, the control portion stops rotation of the rotary member.

14 Claims, 5 Drawing Sheets

IMAGE HEATING APPARATUS

BACKGROUND OF THE INVENTION

1. Field of the Invention

The present invention relates to an image heating apparatus suitable for use as a fixing apparatus to be mounted on an image forming apparatus, such as a copying machine and a laser beam printer (LBP), which adopts an image forming process such as an electrophotographic printing method and an electrostatic recording method.

2. Description of the Related Art

As disclosed in Japanese Patent Application Laid-Open No. H11-024492, a fixing apparatus configured to fix, onto a recording material, a toner image formed on the recording material is provided with an excessive-temperature-rise protection element (thermal fuse or thermo switch) to be activated when sensing an excessive rise in temperature (abnormal rise in temperature) of the fixing apparatus so as to interrupt power supply to a heating member (heater).

By the way, even when the fixing apparatus is brought into a state in which the temperature rises excessively, it cannot be determined whether the excessive rise in temperature is caused by a failure of a drive element (thyristor such as a triac) configured to control the power supply to the heater, or by a malfunction (an incorrect operation) of the drive element instead of the failure. Therefore, even when the fixing apparatus is brought into the state in which the temperature rises excessively due to the failure of the drive element, the mechanical drive (rotating state) of a rotary member,. such as a fixing roller, is maintained until the excessive-temperature-rise protection element interrupts the energization of the heater in a mechanical manner. When the drive element fails, there is a fear in that the power supply to the heater cannot be interrupted. In this case, when the mechanical drive is maintained, positive natural heat dissipation from the rotary member is also maintained, but heat transfer to a component (such as a pressure roller) held in contact with the rotary member is continued. Then, until the temperature reaches to the activation temperature of the protection element, the heat is accumulated in the component held in contact with the rotary member, and in another component (such as a gear) held in contact with that component. Thus, there is a fear of thermal damage to those components.

The fixing apparatus is in failure, and therefore needs to be replaced, but the thermally damaged components can no longer be reused.

SUMMARY OF THE INVENTION

The present invention has been made in view of the above-mentioned problem, and it is therefore an object thereof to protect a component held in contact with a rotary member from thermal damage.

It is another object of the present invention to provide an image heating apparatus, including: a rotary member; a heating member configured to heat the rotary member, the heating member being held in contact with the rotary member; a temperature detecting element configured to detect the temperature of the rotary member or the heating member; a protection element configured to interrupt power supply to the heating member, the protection element being activated when sensing an abnormal rise in temperature of the heating member; and a control portion configured to control the image heating apparatus, wherein, when the temperature detected by the temperature detecting element exceeds a threshold value, the control portion stops rotation of the rotary member.

It is still another object of the present invention to provide an image heating apparatus, including: a rotary member; a heating member configured to heat the rotary member, the heating member being held in contact with the rotary member; a temperature detecting element configured to detect the temperature of the rotary member or the heating member; a protection element configured to interrupt power supply to the heating member, the protection element being activated when sensing an abnormal rise in temperature of the heating member; and a control portion configured to control the image heating apparatus, wherein, when the temperature detected by the temperature detecting element exceeds a first threshold value, the control portion outputs a signal for turning off the power supply to the heating member, and thereafter, when the temperature detected by the temperature detecting element exceeds a second threshold value higher than the first threshold value, the control portion stops rotation of the rotary member.

Further features of the present invention will become apparent from the following description of exemplary embodiments with reference to the attached drawings.

DESCRIPTION OF THE EMBODIMENTS

First Embodiment

Figure 2:
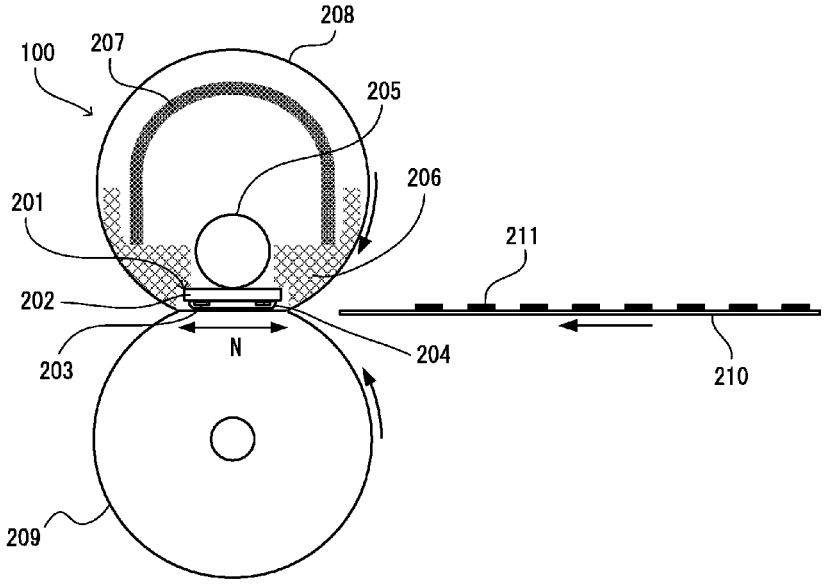
FIG. 2 is a sectional view of the image heating apparatus which is taken at a position at which an excessive temperature rise protection element is disposed.
Figure 3:
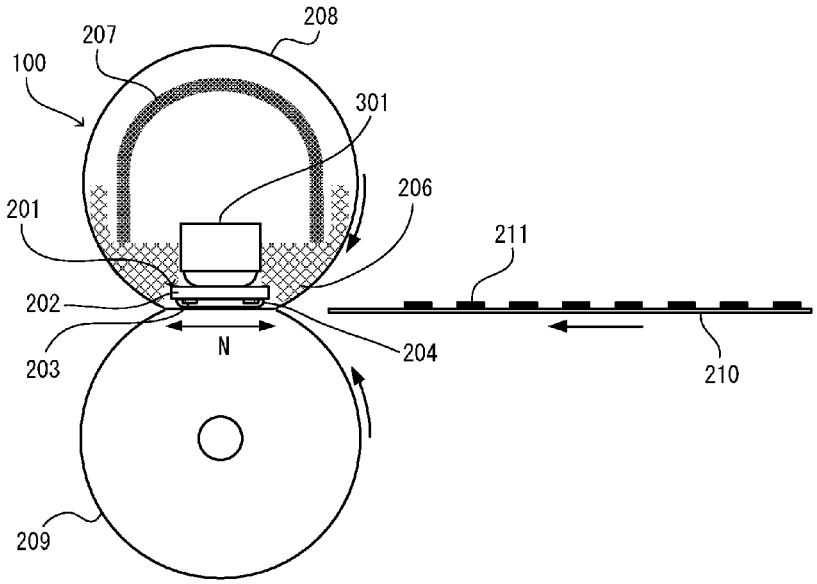
FIG. 3 is a sectional view of the image heating apparatus which is taken at a position at which a temperature detecting element is disposed.

As a first embodiment of the present invention, FIGS. 2 and 3 each illustrate a schematic view of an image heating apparatus 100 to be used in an image forming apparatus. The image heating apparatus 100 of the embodiment includes a fixing film 208, a ceramic heater (hereinafter referred to as "heater") 201 held in contact with an inner surface of the fixing film 208, and a pressure roller 209 configured to form a fixing nip portion N together with the heater 201 through the fixing film 208.

The fixing film 208 serving as a rotary member is a cylindrical film including a base layer made of polyimide, and a fluorine resin layer provided on the base layer.

The heater 201, serving as a heating member, is a low-thermal capacity heater formed into a shape of an elongated thin plate with its longitudinal direction set to a direction perpendicular to the drawing sheet. The heater 201 includes a ceramic substrate 202 having both an insulating property and a high thermal conductivity in a shape of an elongated thin plate, a heating resistor 203 provided on the ceramic substrate 202, and a glass protection layer 204 having an excellent insulating property and configured to cover the heating resistor 203. The temperature of the heater 201 is raised by energization of (power supply to) the heating resistor 203, and is dropped by interruption of the energization.

A heater holder 206 serving as a heating member supporting member has rigidity and an heat insulating property. The heater holder 206 has a groove formed in a lower surface thereof so as to fit the heater 201 therein along a longitudinal direction of the heater holder 206. The heater holder 206 fixes and supports the heater 201 by fitting the heater 201 in the groove. Note that, a metal stay 207 is provided for reinforcement.

The pressure roller (drive roller) 209 includes a silicone rubber layer. The pressure roller 209 has a gear (not shown) provided on a rotation shaft thereof, and when the pressure roller 209 is driven via the gear, the fixing film 208 is rotated in association with the rotation of the pressure roller 209. The pressure roller 209 is in contact with the fixing film 208.

As a material to be heated, a recording material 210 bearing an unfixed toner image 211 formed thereon is nipped and conveyed by the fixing film 208 and the pressure roller 209 at the fixing nip portion N between the fixing film 208 and the pressure roller 209.

The recording material 210 is nipped and conveyed together with the fixing film 208 by the fixing nip portion N, and hence the heater 201 applies heat to the recording material 210 via the fixing film 208, to thereby heat and fix the unfixed toner image 211 onto a surface of the recording material 210. The recording material 210 passing through the fixing nip portion N is conveyed while being separated from the surface of the fixing film 208.

In this case, an excessive-temperature-rise protection element 205 (FIG. 2) to be activated by heat is disposed on a surface of the heater 201 opposite to the surface which is held in close contact with the fixing film 208. The excessive-temperature-rise protection element 205 is a thermal fuse or a thermo switch. When the temperature of the heater 201 rises abnormally, the excessive-temperature-rise protection element 205 is activated to urgently interrupt the energization of the heater 201 in a mechanical manner.

In the longitudinal direction of the heater 201, the excessive-temperature-rise protection element 205 is disposed at a position different from a position at which a temperature detecting element 301 is disposed (FIG. 3). The temperature detecting element 301 is disposed on the surface of the heater 201 opposite to the surface which is held in close contact with the fixing film 208, and is configured to change a resistance value along with the change in temperature of the heater 201, to thereby detect the temperature of the heater 201. The temperature detecting element 301 is a thermistor.

Figure 4:
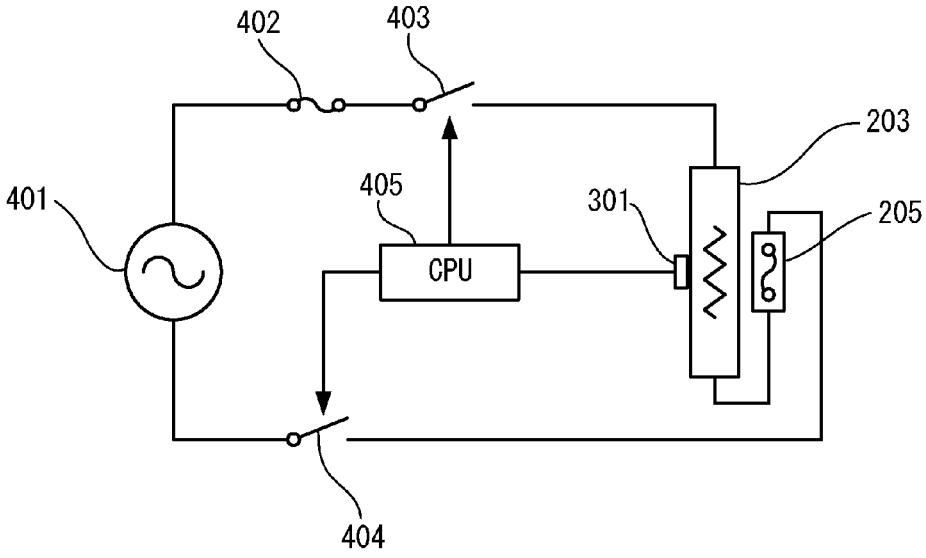
FIG. 4 is a schematic diagram of an electrical connection state of the image heating apparatus.

FIG. 4 is a schematic diagram illustrating an electrical connection state according to the embodiment. A commercial power source 401 is connected to a switch 403, such as a relay, via an overcurrent protection element (power fuse) 402. The switch 403 is connected to the heating resistor 203, which is a component of the heater 201, and the excessive-temperature-rise protection element 205 is connected to the heating resistor 203 in series. A semiconductor switch (drive element) 404, such as a triac, is connected anteriorly to the excessive-temperature-rise protection element 205. A CPU (control portion) 405 controls the semiconductor switch 404 into an energization state or a non-energization state in accordance with a detection result based on the temperature detecting element 301. During the fixing process, the CPU 405 controls the heater 201 (directly controls the semiconductor switch 404) so that the temperature detected by the temperature detecting element 301 is maintained to be a predetermined control target temperature Tnormal.

(Flowchart of Process to be Performed when Heat is Generated Abnormally)

Figure 1:
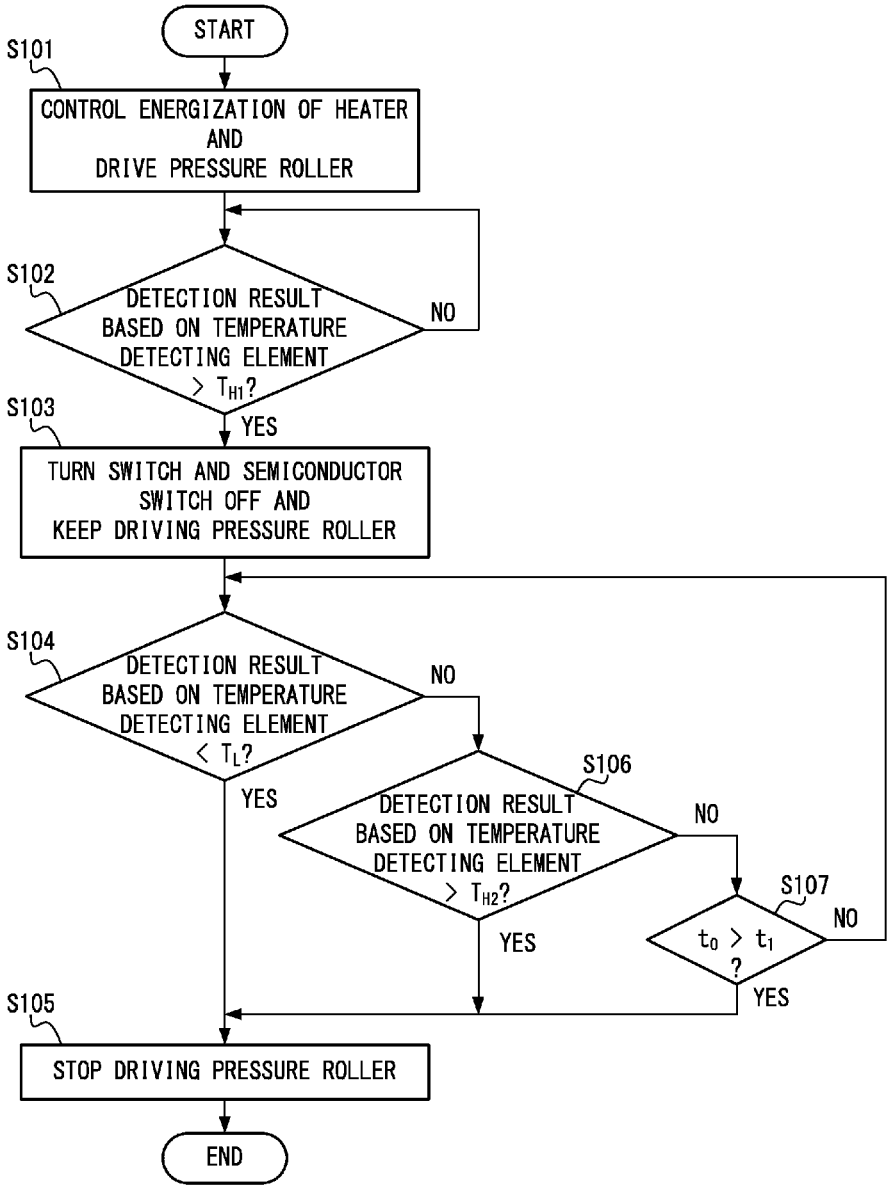
FIG. 1 is a flowchart of control of an image heating apparatus according to a first embodiment.

FIG. 1 is a flowchart of a process to be performed when heat is generated abnormally during the heat-fixing process of the heater 201 according to the embodiment. Referring to FIG. 1, a process against the abnormal heat generation according to the embodiment will be described in detail.

During a period in which the image heating apparatus 100 is driven, the energization of the heater 201 is controlled so that the detection result based on the temperature detecting element 301 indicates the predetermined temperature Tnormal. At this time, the pressure roller 209, serving as a pressure member, is rotationally driven (S101). However, the temperature of the heater 201 rises abnormally when the switch 403 and the semiconductor switch 404 malfunction due to noise or fail due to short-circuit of the respective elements.

In this case, when the detection result based on the temperature detecting element 301 indicates a temperature higher than a first threshold temperature TH1 (>Tnormal), a predetermined number of times or more, the CPU 405 determines that the heater 201 is in an abnormally heated state (S102). When the CPU 405 determines that the heater 201 is in the abnormally heated state, the CPU 405 transmits, to the switch 403 and the semiconductor switch 404, a signal for turning off (stopping) the energization while keeping driving the pressure roller 209 (S103). When the energization is stopped normally, the detection result based on the temperature detecting element 301 indicates a downward tendency of temperature.

When the temperature indicated by the detection result based on the temperature detecting element 301 is lower than a predetermined temperature $T_L$ lower than the first threshold temperature $T_{H1}$ (S104), the CPU 405 determines that the image heating apparatus 100 is cooled at this time, and stops driving the pressure roller 209 (S105).

When the temperature indicated by the detection result based on the temperature detecting element 301 is not lower than the predetermined temperature TL in S104, on the other hand, the temperature indicated by the detection result is compared to a second threshold temperature TH2 higher than the first threshold temperature TH1. When the temperature indicated by the detection result based on the temperature detecting element 301 is higher than the second threshold temperature TH2, the CPU 405 determines that the power supply to the heater 201 cannot be interrupted (S 106).

Along with the determination, the pressure roller 209 transitions from the drive state to the stop state, and hence the heat dissipation from the fixing film 208 to the pressure roller 209 is suppressed. Due to the suppression of the heat dissipation to the pressure roller 209, the temperature of the heater 201 rises abruptly, to thereby promote a temperature rise to an activation temperature TH3 (>TH2) of the excessive-temperature-rise protection element 205. When the temperature of the heater 201 rises to the activation temperature TH3 of the excessive temperature rise protection element 205, the excessive-temperature-rise protection element 205 is activated to interrupt the power supply to the heater 201 in a mechanical manner. That is, the drive of the pressure roller 209 is stopped, and hence the temperature of the heater 201 rises abruptly, to thereby shorten the a time required to activate the excessive-temperature-rise protection element 205. Due to the shortened time required to activate the excessive-temperature-rise protection element 205, the time of the heat dissipation to the pressure roller 209 is shortened, to thereby suppress thermal damage to the silicone rubber layer thereof.

When the temperature indicated by the temperature detection result is equal to or lower than the second threshold temperature $T_{H2}$ in S106, a drive time $t_0$ of the pressure roller 209 is compared to a predetermined time $t_1$. When the drive time $t_0$ is equal to or shorter than the predetermined time $t_1$, the heat dissipation cooling by the drive of the pressure roller 209 is continued (S107). When the drive time $t_0$ is longer than the predetermined time $t_1$, the drive of the pressure roller 209 is stopped, and the image heating apparatus 100 is cooled by only natural heat dissipation.

Figure 5:
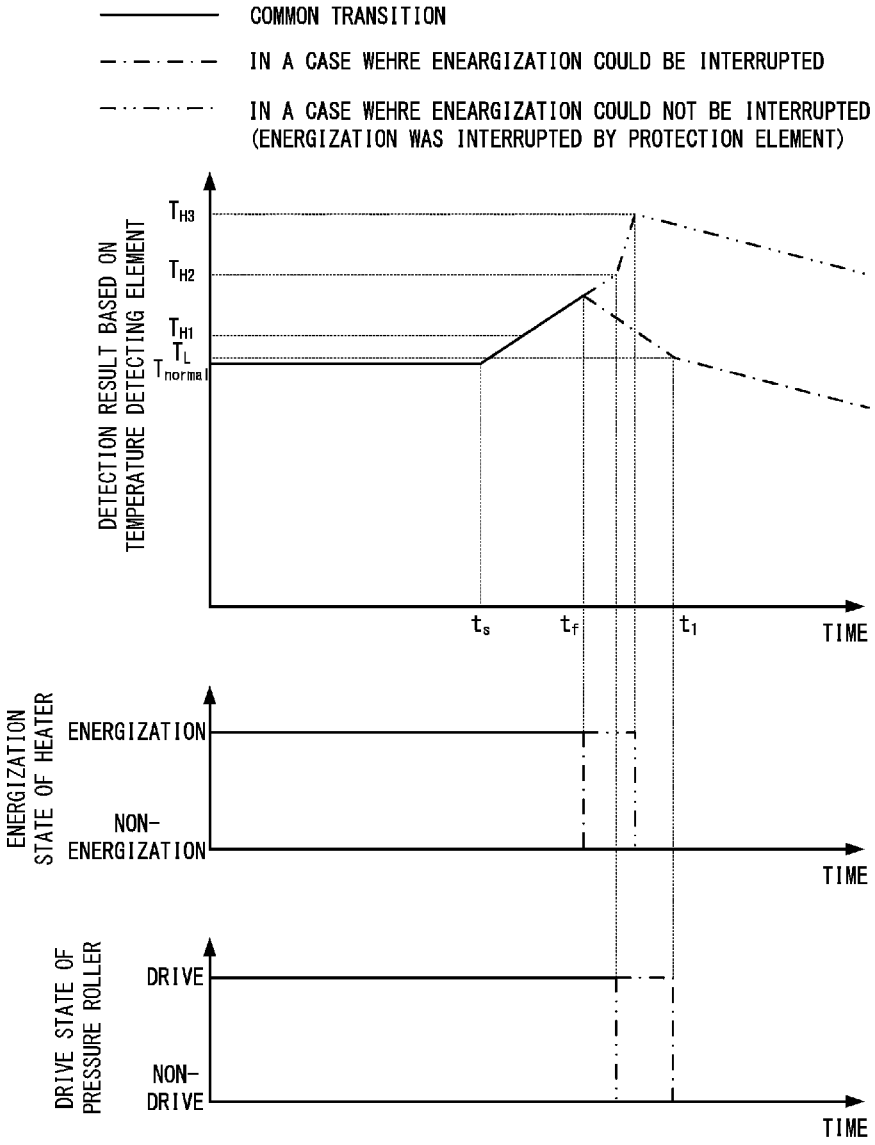
FIG. 5 is a diagram illustrating a time transition on a temperature detection result, a time transition on an energization state, and a time transition on a drive state of a pressure member in the image heating apparatus according to the first embodiment.

FIG. 5 is a diagram illustrating a time transition on the temperature detection result (time transition on the temperature of the heater 201), a time transition on the energization state, and a time transition on the drive state of the pressure member. In FIG. 5, a normal temperature control state is kept until a time point $t_s$. At the time point $t_s$, the energization through the switch 403 and the semiconductor switch 404 is brought into an uncontrolled state due to the noise or failure.

At a time point when the temperature detection result indicates the temperature higher than the first threshold temperature $T_{H1}$ for a predetermined time or longer ("$t_f$" in FIG. 5), the CPU 405 determines that the heater 201 is in the abnormally heated state (S102), and transmits a signal for turning off the switch 403 and the semiconductor switch 404 (S103). The drive of the pressure roller 209 is continued, and when the energization can be interrupted normally through the switch 403 and the semiconductor switch 404, the temperature detection result (temperature of the heater 201) indicates a downward tendency. At a time point when the temperature indicated by the temperature detection result is lower than the temperature $T_L$ (S104), or when the drive time $t_0$ of the pressure roller 209 is longer than the predetermined time $t_1$ (S107), the drive of the pressure roller 209 is stopped, and the heat is naturally dissipated.

On the other hand, when the energization cannot be interrupted due to the failure of the elements of the switch 403 and the semiconductor switch 404, it is conceivable that the temperature may not be dropped even if the drive of the pressure roller 209 is continued. Therefore, at a time point when the temperature detection result indicates the second threshold temperature TH2 (S106), the failure of the switch 403 and the semiconductor switch 404 is predicted, and hence the drive of the pressure roller 209 is stopped (S105). Thus, the temperature of the heater 201 can be raised to the activation temperature TH3 within a time shorter than in the case where the drive state of the pressure roller 209 is continued. When the temperature exceeds the activation temperature TH3, the excessive-temperature-rise protection element 205 is activated.

As described above, in the image heating apparatus 100 according to the embodiment, when the heater 201 generates heat abnormally, the CPU 405 transmits a signal for turning off the energization of the heater 201, and adjusts a timing when the pressure member transitions from the drive state to the stop state in accordance with the detection result based on the temperature detecting element 301 ("YES" and "NO" in S106). Thus, the energization can be interrupted depending on the malfunction or failure state of the switch 403 and the semiconductor switch 404. As a result, when the switch 403 and the semiconductor switch 404 fail in the short-circuit mode, the excessive-temperature-rise excessive temperature rise protection element 205 is activated at an appropriate timing, and thus the excessive thermal damage to the drive transmission gear of the pressure roller 209 can be mitigated.

Note that, in the embodiment, $t_1$ represents a predetermined fixed time (constant time), but this time may be adjusted to a time determined in accordance with the length of the recording material 210 which has been nipped and conveyed until just before the occurrence of the abnormal heat generation (as the recording material 210 is longer, the time is shorter). Thus, it is possible to suppress such a situation that the recording material 210 is wrapped around the pressure roller 209.

Further, in the embodiment, the drive transmission gear of the pressure roller 209 is taken as an example of the component subjected to the excessive thermal damage, but the thermal damage may be suppressed by a similar method also in a case of other members to be heated excessively due to the heat dissipation from the pressure roller 209.

Second Embodiment

Figure 6:
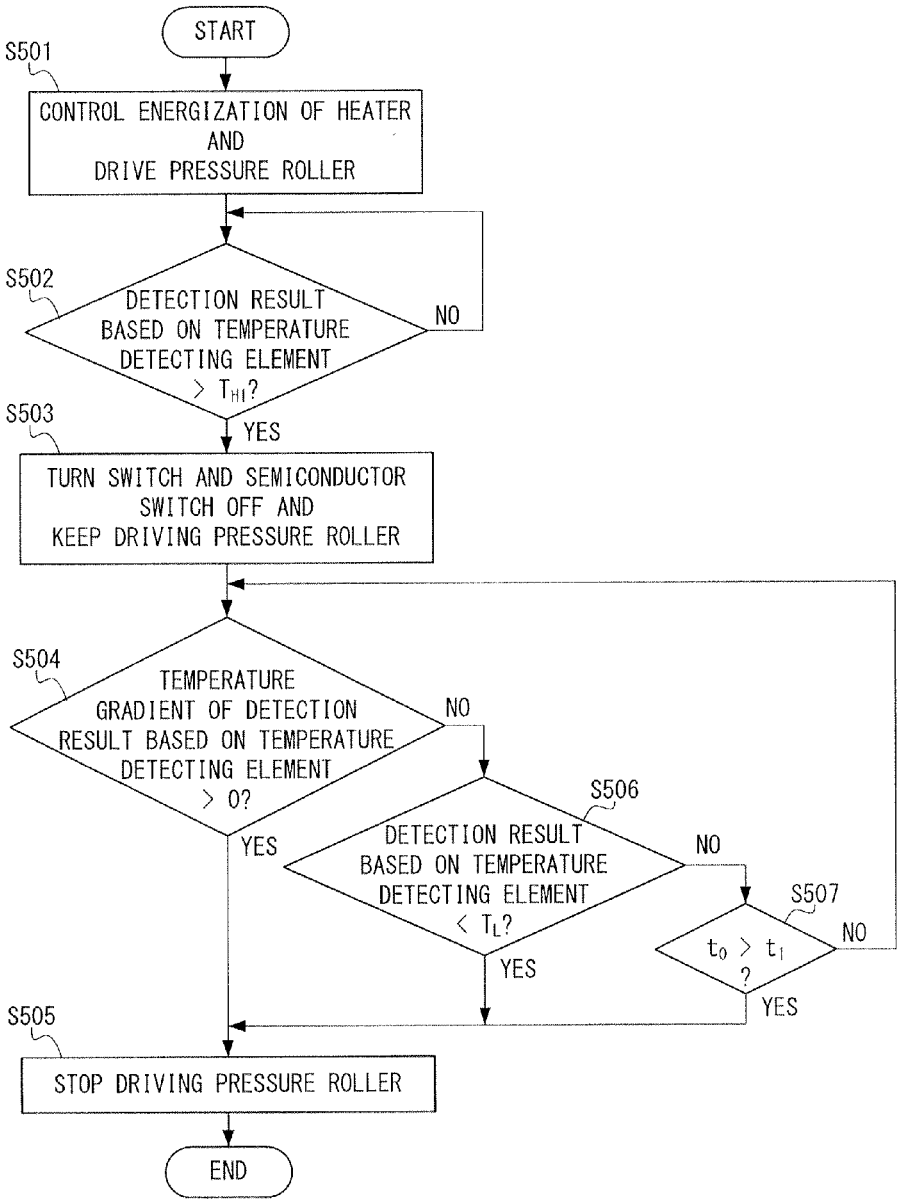
FIG. 6 is a flowchart of control of an image heating apparatus according to a second embodiment.

FIG. 6 is a flowchart of a process to be performed when heat is generated abnormally during the heat-fixing process of the heater 201 according to a second embodiment of the present invention. The process steps which involve the normal control, the determination of abnormal heat generation by the CPU 405, the control for turning off the energization through the switch 403 and the semiconductor switch 404, and the continuous drive of the pressure roller 209 (S501, S502, and S503) are similar to those of the first embodiment.

In S504, the CPU 405 determines whether the temperature gradient (temperature transition) of the heater 201 is ascending or not ascending (descending or the same level). When the gradient of the temperature detection result after the abnormal heat generation is positive, the temperature gradient (temperature transition) is ascending, and hence the failure of the switch 403 and the semiconductor switch 404 due to the short-circuit of the respective elements is predicted. Thus, the drive of the pressure roller 209 is stopped (S505). Then, the excessive-temperature-rise protection element 205 is activated.

When the CPU 405 determines in S504 that the temperature gradient (temperature transition) is not ascending (descending or the same level), at a time point when the temperature indicated by the temperature detection result based on the temperature detecting element 301 is lower than the predetermined temperature $T_L$ lower than the first threshold temperature $T_{H1}$ (S506), the CPU 405 determines that the image heating apparatus 100 is cooled. Then, the drive of the pressure roller 209 is stopped (S505).

When the temperature indicated by the temperature detection result is higher than the threshold temperature $T_L$ in S506, the drive time $t_0$ of the pressure roller 209 is compared to the predetermined time $t_1$. When the drive time $t_0$ is equal to or shorter than the predetermined time $t_1$, the heat dissipation cooling by the drive of the pressure roller 209 is continued (S507). When the drive time $t_0$ is longer than the arbitrary predetermined time $t_1$, the drive of the pressure roller 209 is stopped (S505), and the image heating apparatus 100 is cooled by only the natural heat dissipation.

Also in the embodiment, when the heating portion generates heat abnormally, the CPU 405 transmits a signal for turning off the energization of the heating portion, and adjusts a timing when the pressure member transitions from the drive state to the stop state in accordance with the detection result based on the temperature detecting element 301 ("YES" in S504, and "NO" in S504 and "YES" in S506). Thus, the energization can be interrupted depending on the malfunction or failure state of the switch 403 and the semiconductor switch 404. As a result, when the switch 403 and the semiconductor switch 404 fail in the short-circuit mode, the excessive temperature rise protection element 205 is activated at an appropriate timing, and thus the excessive thermal damage to the drive transmission gear of the pressure roller 209 can be mitigated.

Note that, similarly to the first embodiment, in the second embodiment, $t_1$ represents a predetermined fixed time (constant time), but this time may be adjusted to a time determined in accordance with the length of the recording material 210 which has been nipped and conveyed until just before the abnormal heat generation (as the recording material 210 is longer, the time is shorter). Thus, it is possible to suppress such a situation that the recording material 210 is wrapped around the pressure roller 209.

Modification Examples

The embodiments of the present invention have been described above. For example, various modifications as described below may be made within the scope of the present invention.

In the embodiments described above, the stop state, in which the drive of the pressure member is stopped, is a state in which the rotation of the pressure roller 209 is stopped while the pressure roller 209 keeps in contact with the fixing film 208, but may be a state in which the pressure roller 209 is spaced apart from the fixing film 208.

Further, the heating portion is not limited to the heater 201, and the fixing film 208 may include an energization portion and have a self-heating function, or the fixing film 208 may generate heat with electromagnetic induction heating.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-270299, filed Dec. 11, 2012, which is hereby incorporated by reference herein in its entirety.

What is claimed is:

1. An image heating apparatus, comprising:

a rotary member;

a heating member configured to heat the rotary member, the heating member being held in contact with the rotary member;

a temperature detecting element configured to detect the temperature of the rotary member or the heating member;

a protection element configured to interrupt power supply to the heating member, the protection element being activated when sensing an abnormal rise in temperature of the heating member; and a control portion configured to control the image heating apparatus, wherein, when the temperature detected by the temperature detecting element exceeds a threshold value, the control portion stops rotation of the rotary member to shorten a time required to activate the protection element.

2. An image heating apparatus according to claim 1, further comprising a roller configured to be brought into contact with a surface of the rotary member.

3. An image heating apparatus according to claim 2, wherein the roller comprises a drive roller configured to rotate the rotary member.

4. An image heating apparatus according to claim 1, wherein the protection element comprises a thermal fuse or a thermo switch.

5. An image heating apparatus according to claim 1, wherein the rotary member comprises a film.

6. An image heating apparatus according to claim 5, wherein the heating member comprises a ceramic heater.

7. An image heating apparatus, comprising:

a rotary member;

a heating member configured to heat the rotary member, the heating member being held in contact with the rotary member;

a temperature detecting element configured to detect the temperature of the rotary member or the heating member;

a protection element configured to interrupt power supply to the heating member, the protection element being activated when sensing an abnormal rise in temperature of the heating member; and a control portion configured to control the image heating apparatus, wherein, when the temperature detected by the temperature detecting element exceeds a first threshold value, the control portion outputs a signal for turning off the power supply to the heating member, and thereafter, when the temperature detected by the temperature detecting element exceeds a second threshold value higher than the first threshold value, the control portion stops rotation of the rotary member.

8. An image heating apparatus according to claim 7, wherein, when the temperature detected by the temperature detecting element exceeds the first threshold value, the control portion outputs the signal for turning off the power supply to the heating member while continuing the rotation of the rotary member.

9. An image heating apparatus according to claim 8, wherein, when the temperature detected by the temperature detecting element exceeds the second threshold value, the control portion stops the rotation of the rotary member to shorten a time required to activate the protection element.

10. An image heating apparatus according to claim 7, further comprising a roller configured to be brought into contact with a surface of the rotary member.

11. An image heating apparatus according to claim 10, wherein the roller comprises a drive roller configured to rotate the rotary member.

12. An image heating apparatus according to claim 7, wherein the protection element comprises a thermal fuse or a thermo switch.

13. An image heating apparatus according to claim 7, wherein the rotary member comprises a film.

14. An image heating apparatus according to claim 13, wherein the heating member comprises a ceramic heater.

* * * * *